United States Patent [19]

Gebhardt

[11] Patent Number: 4,952,123

[45] Date of Patent: Aug. 28, 1990

[54] AUXILIARY DRIVE ON AN INTERNAL COMBUSTION ENGINE FOR AN AIR COMPRESSOR

[75] Inventor: Hans Gebhardt, Langenzenn, Fed. Rep. of Germany

[73] Assignee: MAN Nutzfahrzeuge GmbH, München, Fed. Rep. of Germany

[21] Appl. No.: 306,344

[22] Filed: Feb. 3, 1989

[30] Foreign Application Priority Data

Feb. 13, 1988 [DE] Fed. Rep. of Germany ..... 3804574

[51] Int. Cl.[5] ..... F04B 35/00

[52] U.S. Cl. ..... 417/380; 74/397

[58] Field of Search ..... 417/364, 480; 74/397, 74/409; 92/140

[56] References Cited

U.S. PATENT DOCUMENTS

| | | | |
|---|---|---|---|
| 1,196,609 | 8/1916 | Stewart | 417/364 |
| 2,444,734 | 7/1948 | Gillett | 74/397 |
| 2,552,703 | 5/1951 | Alonso | 417/539 |
| 3,888,134 | 6/1975 | Miranda | 74/409 |
| 4,671,223 | 6/1987 | Asano et al. | 123/90.31 |

*Primary Examiner*—John J. Vrablik
*Assistant Examiner*—Robert N. Blackmon
*Attorney, Agent, or Firm*—Robert W. Becker & Associates

[57] ABSTRACT

A gear wheel driven air compressor that is constructed as a piston compressor, the drive gear wheel of which, on the air compressor crankshaft, meshes with a gear wheel on the camshaft of the internal combustion engine. With drives of this type, the negative torque of the air compressor, which is produced once the upper dead center position of the air compressor piston has been reached, leads to a sudden flank change in the tooth mesh, which is associated with an unpleasant noise. In order to reduce this noise, it is known to make the meshing flank clearance as small as possible. However, clearances which are too small lead to increased rotational bending strain on the air compressor crankshaft and the camshaft. In order to prevent this, a sinusoidal meshing flank clearance change is proposed, which is obtained via a specific eccentricity of the air compressor drive gear wheel, which is associated with the upper dead center position of the air compressor piston.

2 Claims, 1 Drawing Sheet

AUXILIARY DRIVE ON AN INTERNAL COMBUSTION ENGINE FOR AN AIR COMPRESSOR

BACKGROUND OF THE INVENTION

The present invention relates to an auxiliary drive of an internal combustion engine for an air compressor. The compressor has a piston that is guided in a cylinder and is driven via a connecting rod by a crankshaft. The crankshaft is connected with a drive gear wheel that is driven by the drive shaft of the internal combustion engine via gear wheels. The air compressor drive gear wheel meshes with a gear wheel on the camshaft.

When compared with V-belt drives, gear wheel driven air compressors of the aforementioned general type have the enormous advantage of a maintenance-free drive. The disadvantage in this case, however, is that the (compressed) air remaining in the cylinder clearance of the air compressor, once the upper dead center position has been reached, expands, with the tangential force that drives the air compressor suddenly becoming negative and the air compressor releasing torque. This leads to a sudden flank change in the tooth mesh accompanied by an unpleasant banging or knocking noise. An additional problem is that the greatest relative noise generation by the air compressor gear wheel drive occurs when the engine is idling after a braking maneuver and the air container is again filled with compressed air (for the compressed air systems, such as the brake system, sliding doors, and the like). Due to the low ignition pressures, the noise of the engine is very low in this case and the flank change of the gear wheel pair is correspondingly clearly noticeable.

A whole series of measures known for eliminating these drawbacks (i.e. reduction of the meshing flank clearance) can be noted as follows:

1. A substitution of the mating of materials of the gear wheel pair from steel to cast iron.
2. The use of a split air compressor clearance compensation gear wheel.
3. A narrowing of the meshing flank clearance by increasing the tooth gauge width.
4. Clearance adjustment by cam adjustment.

All of these measures are either expensive to manufacture or are space-consuming and structurally complicated and necessitate additional expenditure at the engine assembly line respectively with an air compressor exchange in the factory. In addition to this, the possibility of faults and inaccuracies as a result of individual adjustment practices is high. However, the greatest disadvantage associated with clearances which are too small is the increased axial pressure that is exerted over the entire circumference of the air compressor bearing and the air compressor crankshaft as well as of the camshaft and crankshaft bearings. With drive shafts having roller bearings, radial loads represent seriously impaired operating conditions. With drive shafts having friction bearings, a high bearing temperature and premature bearing failure result from the constant axial pressure. This finally results in a reduced service life of the entire air compressor arrangement.

It is an object of the present invention to reduce the noise generation of the tooth flanks, in particular in the region of the upper dead center position of the air compressor piston, while also avoiding increased rotational bending strain on the air compressor crankshaft and the camshaft.

BRIEF DESCRIPTION OF THE DRAWINGS

This object, and other objects and advantages of the present invention, will appear more clearly from the following specification in conjunction with the accompanying drawing, in which.

SUMMARY OF THE INVENTION

The air compressor auxiliary drive of the present invention is characterized primarily in that the air compressor drive gear wheel has a specific or defined eccentricity, and in that the maximum increase in the eccentricity is associated with the upper dead center position of the air compressor piston, which is obtained by an aligned arrangement of the air compressor drive gear wheel relative to the air compressor crankshaft.

By means of the present invention, the tooth clearance between the air compressor drive gear wheel and the gear wheel on the camshaft is kept small only at the necessary point in time (i.e. in the region of the upper dead center position of the air compressor piston). With the air compressor crankshaft rotation there is essentially a sinusoidal change in the meshing flank clearance (no clearance or minimum clearance at the upper dead center position, greatest clearance at the lower dead center position), which leads to a considerable improvement of the load level in the air compressor drive. With drive shafts having roller bearings, a spot load is exerted on the roller bearing inner ring instead of an unfavorable radial load. Similarly, with drive shafts having friction bearings, an increased service life of the friction bearing is obtained (since the loading conditions as well as the lubrication and cooling functions are improved).

The securing of the air compressor drive gear wheel at the end of the crankshaft can be effected by means of an adapter sleeve, with the maximum increase in the eccentricity associated with the upper dead center position of the air compressor lying in a straight line connecting the central points of the two gear wheels (air compressor drive gear wheel and gear wheel on the camshaft); (the tooth mesh between the two gear wheels represents the connection). In this respect, a specific angle $\phi$ is defined between the cylinder axis (piston axis) of the air compressor and the above-mentioned connecting line between the two central points of the gear wheels.

Further specific features of the present invention will be described in detail subsequently.

DESCRIPTION OF PREFERRED EMBODIMENTS

Figure 1:
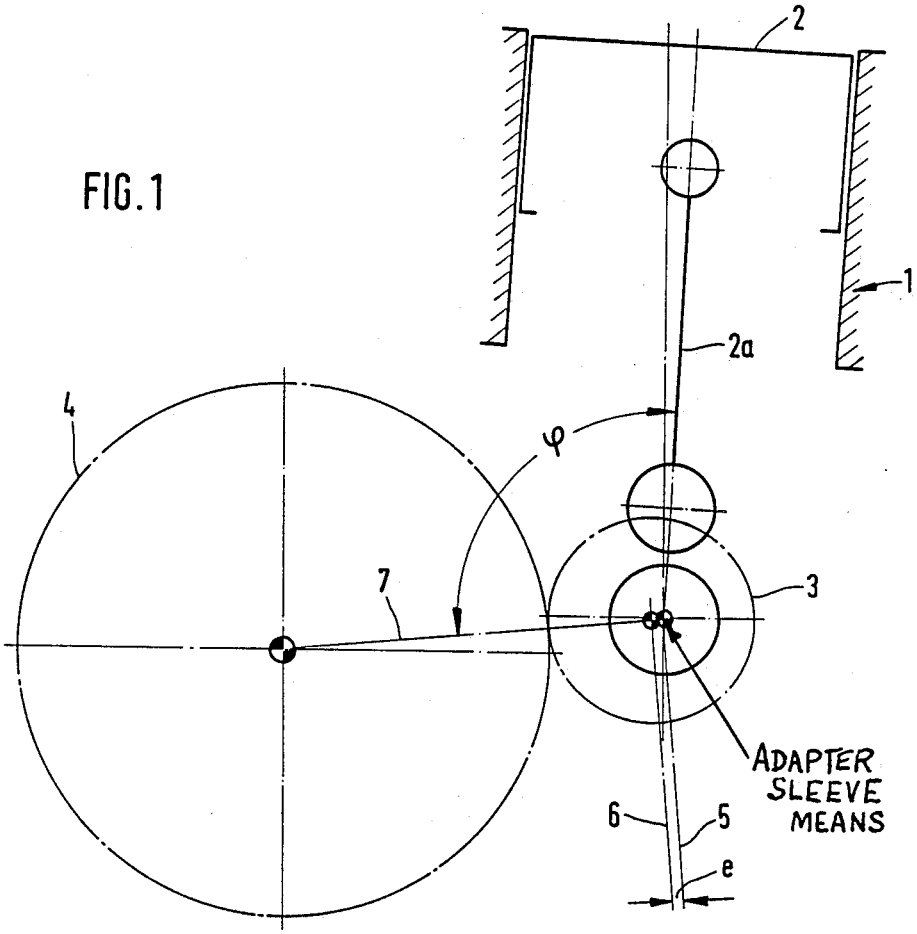
FIG. 1 is a schematic front cross-sectional view of one exemplary embodiment of the inventive auxiliary drive for an air compressor, the drive gear wheel of which is disposed on a crankshaft and meshes with a gear wheel on the internal combustion engine camshaft, with the air compressor drive gear wheel having a defined eccentricity.

Referring now to the drawing in detail, FIG. 1 shows an air compressor 1, which is constructed as a piston compressor having a piston 2 that is guided in a cylinder. The piston 2 is driven in a known manner (not shown directly) via a connecting rod by a crankshaft, which is connected with a drive gear wheel 3. This drive gear wheel 3 meshes with a gear wheel 4 on the camshaft of the internal combustion engine. The gear wheel 4, in turn, is driven via gear wheels by the drive shaft of the internal combustion engine (not shown).

The air compressor drive gear wheel 3 has a defined eccentricity "e". The eccentricity represents the central point distance between the center (central point axis 6) of the rotating toothing of the drive gear wheel 3 and the axis of rotation 5 of the air compressor crankshaft. In this connection, the maximum increase in the eccentricity "e", which is associated with the upper dead center position (OT) of the air compressor piston 2, lies in a connecting line 7 between the central points of the gear wheels or, more precisely, between the two axes of rotation of the drive gear wheel 3 and the gear wheel 4 on the camshaft. In this connection, a specific angle $\phi$ is defined between the connecting line 7 and the cylinder axis 2*a* (piston axis) of the air compressor 1.

The drive gear wheel 3 is arranged in alignment on the air compressor crankshaft by means of a non-illustrated adapter sleeve, i.e. is arranged in association with the upper dead center position of the air compressor piston 2. In other words, the air compressor drive gear wheel 3 is fixed in a particular position (angular position) on the air compressor crankshaft.

Figure 2:
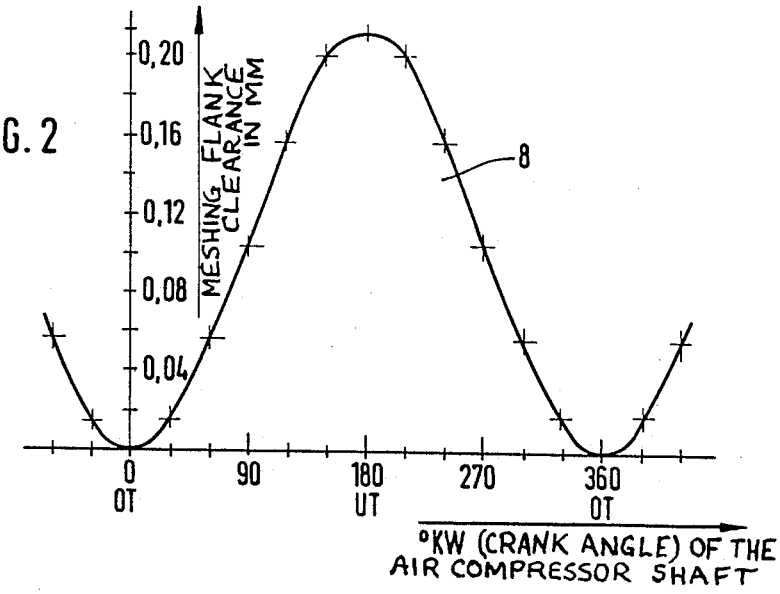
FIG. 2 is a view that shows a graph illustrating the curve of the meshing flank clearance between the gear wheel on the camshaft and the air compressor drive gear wheel during one air compressor crankshaft rotation.

FIG. 2 shows the meshing flank clearance change 8 of the gear wheel pair $\frac{3}{4}$ during one air compressor crankshaft rotation of 360°. In this connection, the meshing flank clearance is plotted in mm on the ordinate and the crank angle of the air compressor shaft is plotted on the abscissa. The clearance curve applies for an eccentricity of $e=0.15$ mm. At the upper dead center position (OT) of the air compressor piston 2 there is no clearance, whereas the greatest clearance occurs at the lower dead center position (UT) of the piston 2.

It would also be conceivable to associate the maximum increase in the eccentricity not exactly with the upper dead center position but only with the general region of the upper dead center position of the air compressor piston 2. In this way, it is possible to influence any arising gear wheel noise, caused by the second zero passage of the tangential force of the air compressor piston (approximately 30 to 50 crank angle degrees of the air compressor shaft after the upper dead center position). Furthermore, by selecting a different tooth gauge width of the drive gear wheels or by a correction of the axial distance, it is possible to move the minimum meshing flank clearance into the positive or negative range.

A further advantage of the present invention, with a possible preceding clearance adjustment by means of a cam, lies especially in the fact that it is possible here to mount the air compressor without the need for any complicated adjustment measurements. (The air compressor drive gear wheel is rotated with its maximum eccentricity in the connecting line and is set to flank clearance 0 by adjusting the cam).

The present invention is, of course, in no way restricted to the specific disclosure of the specification and drawing, but also encompasses any modifications within the scope of the appended claims.

What I claim is:

1. In an auxiliary drive of an internal combustion engine for an air compressor, which is constructed as a piston compressor having a piston that is guided in a cylinder and is driven via a connecting rod by a crankshaft, which is connected with a drive gear wheel that has tooth flanks and that is driven by the drive shaft of the internal combustion engine via gear wheels also having tooth flanks, with the air compressor drive gear wheel having tooth flanks meshing with a gear wheel also having tooth flanks and being mounted on the camshaft of said engine, comprising the improvement therewith wherein:

said air compressor drive gear wheel has a specific eccentricity, said eccentricity being associated with an upper dead center position of said air compressor piston, this being obtained by an aligned arrangement of said air compressor drive gear wheel relative to said air compressor crankshaft, said air compressor drive gear wheel and said gear wheel on the camshaft of said engine in the upper dead center position of the air compressor piston having minimal spacing therebetween due to a maximum in said eccentricity being attained at the upper dead center position of said air compressor piston with which reduction of noise generation of the tooth flanks particularly in a region of the upper dead center position of the air compressor piston is attained while also avoiding increased rotational bending strain on the air compressor crankshaft and the camshaft.

2. An auxiliary drive according to claim 1, which includes an adapter sleeve means for securing said air compressor drive gear wheel on said air compressor crankshaft.

* * * * *